US011641069B2

(12) United States Patent
Naemura

(10) Patent No.: US 11,641,069 B2
(45) Date of Patent: May 2, 2023

(54) CONNECTOR HOUSING AND TERMINAL ARRANGEMENT FOR A STACKED-TYPE WIRE HARNESS

(71) Applicant: J.S.T. Mfg. Co., Ltd., Tokyo (JP)

(72) Inventor: Ryo Naemura, Osaka (JP)

(73) Assignee: J.S.T. MFG. CO., LTD., Tokyo (JP)

( * ) Notice: Subject to any disclaimer, the term of this patent is extended or adjusted under 35 U.S.C. 154(b) by 0 days.

(21) Appl. No.: 17/036,912

(22) Filed: Sep. 29, 2020

(65) Prior Publication Data

US 2021/0098900 A1 Apr. 1, 2021

(30) Foreign Application Priority Data

Oct. 1, 2019 (JP) ..... JP2019-181706

(51) Int. Cl.
*H01R 4/28* (2006.01)
*H01R 4/18* (2006.01)

(52) U.S. Cl.
CPC ..... *H01R 4/28* (2013.01); *H01R 4/18* (2013.01)

(58) Field of Classification Search
CPC .... H05K 5/0073; H01R 4/28; H01R 13/5833; H01R 12/75
See application file for complete search history.

(56) References Cited

U.S. PATENT DOCUMENTS 5,380,220 A * 1/1995 Okabe ..... H01R 13/506 439/456
6,383,012 B1 * 5/2002 Kisu ..... H01R 4/2454 439/402
10,811,817 B1 * 10/2020 Peterson ..... H01R 13/58

FOREIGN PATENT DOCUMENTS

JP 2009-252715 A 10/2009

* cited by examiner

*Primary Examiner* — Vanessa Girardi
(74) *Attorney, Agent, or Firm* — Kratz, Quintos & Hanson, LLP

(57) ABSTRACT

A connector includes multiple first terminals, multiple second terminals, and a housing that holds the terminals. The first terminals are arranged side-by-side in a width direction of the housing, and the second terminals are also arranged side-by-side in the width direction. In the housing, the first terminals are arranged side-by-side with the second terminals in a front-rear direction that is perpendicular to the width direction. In a state where first electrical wires are connected to the first terminals and second electrical wires are connected to the second terminals, the first electrical wires are drawn out to one side in the front-rear direction of the housing, and the second electrical wires are drawn out to the other side in the front-rear direction of the housing.

7 Claims, 14 Drawing Sheets

CONNECTOR HOUSING AND TERMINAL ARRANGEMENT FOR A STACKED-TYPE WIRE HARNESS

CROSS-REFERENCE TO RELATED APPLICATION

This application claims priority to Japanese Patent Application No. 2019-181706. The entire disclosure of Japanese Patent Application No. 2019-181706 is hereby incorporated herein by reference.

BACKGROUND OF THE INVENTION

1. Field of the Invention

The present invention relates to a connector for connecting multiple electrical wires to a connection target member.

2. Description of Related Art

As a device for connecting multiple electrical wires to a connection target member there is a conventionally known connector having a configuration in which electrical wires are connected to a partner connector mounted on a substrate that is the connection target member. For example, JP 2009-252715A discloses a connector for connecting multiple electrical wires to a substrate. Specifically; the connector in JP 2009-252715A includes multiple terminals, and is configured such that electrical wires are connected to the terminals. After the electrical wires are connected to the terminals of the connector the connector is connected to a partner connector mounted on a substrate. The electrical wires are thus electrically connected to the substrate.

SUMMARY OF THE INVENTION

A connector disclosed in JP 2009-252715A has a configuration in which electrical wires are drawn out and extend from a lateral surface on one side of the connector With this configuration in which electrical wires are drawn out from the lateral surface on one side of the connector, the number of electrical wires that can be arranged in the connector is limited by the area of the one lateral surface of the connector. For this reason, it is difficult to arrange electrical wires densely in the connector overall.

Also, in the connector disclosed in JP 2009-252715A, because the electrical wires are drawn out and extend outward from the connector, the outward extending portions of the electrical wires bend downward from the connector. For this reason, when performing a task in which the connector is arranged on and connected to a connection target, member such as a substrate, the electrical wires connected to the connector or electrical wires connected to another connector connected to the substrate can easily hinder the task of arranging the connector. Accordingly there is a problem of a tendency to invite a decrease in workability when the connector is arranged on a connection target member such as a substrate.

Also, the connector disclosed in JP 2009-252715A has an approximately flat configuration. For this reason, in terms of work efficiency there is desire for the ability for multiple connectors to be stacked in the thickness direction and transported as a group. However, the connector disclosed in JP 2009-252715A has an approximately rectangular outer shape, and it is not easy to grip and transport; individual connectors with use of a robot arm that has a simple configuration, for example. For this reason, it is not easy to perform the task of gripping and transporting individual connectors in order to form one compact group of connectors, and it is also not easy to perform a task for successively gripping and transporting individual connectors that are in a compact group.

In light of the foregoing circumstances, an object of the present invention is to provide a connector in which multiple electrical wires can be arranged densely.

Another object of the present invention is to provide a connector that can suppress the case where electrical wires become a hindrance, and that can facilitate a task for arrangement on and connection to a connection target member.

Yet another object of the present invention is to provide a connector that enables easily performing a task for gripping and transporting individual connectors in order to form a compact group, and also enables easily performing a task for successively gripping and transporting individual connectors that are in a compact group.

(1) In order to solve the foregoing problems, a connector according to an aspect of the present invention includes: a plurality of first terminals; a plurality of second terminals; and a housing configured to hold the first terminals and the second terminals, wherein the first terminals are arranged side-by-side along a width direction of the housing, and the second terminals are arranged side-by-side along the width direction of the housing, in the housing, the first terminals, which are arranged side-by-side along the width direction, are arranged side-by-side with the second terminals, which are arranged side-by-side along the width direction, along a front-rear direction that is perpendicular to the width direction of the housing, and in a state where first electrical wires are respectively connected to the first terminals and second electrical wires are respectively connected to the second terminals, the first electrical wires connected to the first terminals are drawn out from the first terminals to one side in the front-rear direction of the housing, and the second electrical wires connected to the second terminals are drawn out from the second terminals to another side in the front-rear direction of the housing.

According to this configuration, in the connector the first terminals are arranged side-by-side along the width direction of the housing, the second terminals are arranged side-by-side along the width direction of the housing, and in the housing, the first terminals, which are arranged side-by-side along the width direction, are arranged side-by-side with the second terminals, which are arranged side-by-side along the width direction, along the front-rear direction of the housing that is perpendicular to the width direction. The first electrical wires are respectively connected to the first terminals and are drawn out to one side in the front-rear direction of the housing, and the second electrical wires are respectively connected to the second terminals and are drawn out to the other side in the front-rear direction of the housing. In other words, electrical wires are not only arranged on one side of the housing in the front-rear direction, but also can be arranged on the other side of the housing in the front-rear direction. Accordingly, the electrical wires can be drawn out to both the front and rear sides of the housing along the front-rear direction. As a result, electrical wires can be arranged densely in the connector.

Therefore, according to this configuration, it is possible to provide the connector in which multiple electrical wires can be arranged densely.

(2) It is preferable that the housing includes a first support portion that is plate-shaped and configured to support portions of the first electrical wires connected to the first terminals, the supported portions being portions that are drawn out from the first terminals, and a second support portion that is plate-shaped and configured to support portions of the second electrical wires connected to the second terminals, the supported portions being portions that are drawn out from the second terminals.

According to this configuration, the housing includes the first support portion and the second support portion that are plate-shaped. The first support, portion is configured to support portions of the first electrical wires that are drawn out from the first terminals when the first electrical wires are connected. Also, the second support portion is configured to support portions of the second electrical wires that are drawn out from the second terminals when the second electrical wires are connected. For this reason, the portions of the electrical wires that are drawn out from the terminals can be prevented from bending so as to sag downward, for example. Accordingly the portions of the electrical wires that are drawn out from the terminals can be protected.

(3) It is preferable that the first support portion is provided with first guide grooves into which portions of the first electrical wires are fitted, the fitted portions being portions that are connected to and drawn out from the first terminals, and the second support portion is provided with second guide grooves into which portions of the second electrical wires are fitted, the fitted portions being portions that are connected to and drawn out from the second terminals.

According to this configuration, portions of the first electrical wires that are drawn out from the first terminals are respectively fitted into the first guide grooves, and portions of the second electrical wires that are drawn out from the second terminals are respectively fitted into the second guide grooves. For this reason, it is possible to reliably prevent the case where the portions of the first electrical wires drawn out from the first terminals and the portions of the second electrical wires drawn out from the second terminals become tangled with each other.

(4) It is preferable that the first support portion is provided with a first inclined surface formed by providing the first support portion such that a thickness of the first support portion decreases toward the one side in the front-rear direction, and the second support portion is provided with a second inclined surface formed by providing the second support portion such that a thickness of the second support portion decreases toward the other side in the front-rear direction.

According to this configuration, the first support portion is provided with the first inclined surface, and the second support portion is provided with the second inclined surface. The first inclined surface is formed by providing the first support portion such that the thickness thereof decreases toward one side of the housing in the front-rear direction. Also, the second inclined surface is formed by providing the second support portion such that the thickness thereof decreases toward the other side of the housing in the front-rear direction. For this reason, the first electrical wires are guided by the first inclined surface so as to be easily fitted into the first guide grooves along the extending direction. Also, the second electrical wires are guided by the second inclined surface so as to be easily fitted into the second guide grooves along the extending direction. Accordingly, the first electrical wires can be easily fitted into the first guide grooves, and the second electrical wires can be easily fitted into the second guide grooves.

(5) In order to solve the foregoing problems, a connector according to an aspect of the present invention includes: a housing; and a plurality of terminals held in the housing, wherein the housing is provided with an electrical wire holding portion configured to hold a portion of an electrical wire, and the electrical wire holding portion is configured to hold a portion other than an end portion of the electrical wire that is drawn out and extends from a corresponding terminal among the plurality of terminals when connected to the corresponding terminal, the held portion being a portion that extends from a bent portion of the electrical wire that is drawn out and extends from the corresponding terminal, or is configured to hold a portion other than an end portion of the electrical wire that is drawn out and extends from another connector different from the connector when connected to the other connector.

According to this configuration, the connector includes the housing and the terminals held in the housing, and the housing is provided with the electrical wire holding portion configured to hold a portion of an electrical wire. The electrical wire holding portion is configured to hold a portion other than the end portion of the electrical wire that extends from the corresponding terminal, the held portion being a portion that extends from a bent portion of the electrical wire. Alternatively, the electrical wire holding portion is configured to hold a portion other than the end portion of an electrical wire that extends from another connector.

Therefore, according to this configuration, in the case where the electrical wire holding portion is to hold a portion, other than the end portion, that extends from the bent portion of the electrical wire that extends from the corresponding terminal, that portion of the electrical wire can be held in the electrical wire holding portion. Accordingly it is possible to suppress the case where the electrical wires that extend from the connector become a hinderance when the connector is transported, and the tasks of connection to and arrangement on the connection target member can be performed easily.

Also, according to this configuration, in the case where the electrical wire holding portion is to hold a portion, other than the end portion, of an electrical wire that extends from another connector, a worker transporting the connector can use the electrical wire holding portion of the connector to hold the electrical wire that extends from the other connector, and it is possible to suppress the case where the electrical wires become a hinderance when connecting and arranging the connector. Accordingly, the worker can suppress the case where the electrical wires become a hinderance, and can easily perform the tasks of connection to and arrangement on the connection target member.

Therefore, according to this configuration, it is possible to suppress the case where the electrical wires become a hinderance during the tasks of connecting and arranging the connector and the tasks of connection to and arrangement on the connection target member can be performed easily.

(6) It is preferable that the electrical wire holding portion is a holding groove that is shaped as a groove into which the electrical wire is fitted.

According to this configuration, the electrical wire holding portion is configured as the holding groove that is shaped as a groove. For this reason, the electrical wire drawn out from the corresponding terminal is fitted into and held in the holding groove. Accordingly, the electrical wire is fitted into and reliably held in the electrical wire holding portion, and it is possible to prevent the electrical wire from coming out of the electrical wire holding portion even when the connector is being transported. As a result, it is possible to more reliably prevent the electrical wires from hindering operations when the connector is arranged.

(7) It is preferable that the holding groove is provided extending parallel with a direction in which the electrical wire connected to the corresponding terminal is drawn out.

According to this configuration, the drawn direction of the electrical wire connected to the terminal and the extending direction of the holding groove are parallel with each other. For this reason, the portion of the electrical wire drawn out from the terminal can be held in a straight shape by the holding groove. Accordingly, the connector can compactly and efficiently hold the portion of the electrical wire drawn out from the housing.

(8) It is preferable that a projection is formed on an inner surface of the holding groove, the projection being configured to prevent the electrical wire fitted into the holding groove from moving out of the holding groove.

According to this configuration, the projection is provided on an inner surface of the holding groove, and the projection prevents the electrical wire held in the holding groove from moving out of the holding groove. For this reason, the electrical wire held in the holding groove is caught on the projection and is not likely to fall out of the holding groove. Accordingly the worker can reliably prevent the electrical wire from coining out of the holding groove and hindering operations when transporting the connector.

(9) In order to solve the foregoing problems, a connector according to an aspect of the present invention includes: a housing; and a plurality of terminals held in the housing, wherein the housing includes a housing main body portion configured to hold the terminals to which electrical wires are to be connected, and a pair of projection portions that project from the housing main body portion, the pair of projection portions project from the housing main body portion to respective sides in a direction perpendicular to a direction in which the electrical wires are drawn out from the terminals held in the housing main body portion, and the pair of projection portions each include a positioning portion that has a plurality of slide surfaces and is a portion configured for use when the connector is positioned, and a hold target portion that is a portion configured to be held by a holding tool for holding the connector.

According to this configuration, the connector includes the housing and the terminals held in the housing, and the housing includes the housing main body portion and the pair of projection portions that project from the housing main body portion. Also, the pair of projection portions project from the housing main body portion to respective sides in the direction perpendicular to the direction in which the electrical wires are drawn out from the terminals held by the housing main body portion. The projection portions each have a hold target portion that is a portion held by a holding tool for holding the connector. For this reason, the hold target portions of individual connectors can be held and transported by the holding tools.

Also, according to this configuration, the projection portions each include the positioning portion that has multiple slide surfaces and is a portion configured for use when the connector is positioned. For this reason, by attaching rail members having a shape that corresponds to the slide surfaces in order to stack multiple connectors for example, it is possible to stack multiple connectors into a group. As a result, the worker can easily perform a task of gripping and transporting multiple connectors. Also, because the connectors include the above-described pairs of projection portions, the worker can also easily perform a task of successively gripping and transporting individual connectors from the stacked group.

Therefore, according to this configuration, it is possible to easily perform a task of gripping and transporting individual connectors in order to form a compact group of connectors, and it is also possible to easily perform a task of successively gripping and transporting individual connectors from a compactly stacked group of connectors.

(10) It is preferable that the positioning portion is shaped as a groove, the hold target portion includes a recession portion that is shaped as a recession into which the holding tool fits, and a step portion that is arranged side-by-side with the recession portion in a height direction of the housing and has a level difference relative to the recession portion the pair of projection portions is provided on both one end portion and another end portion of the housing with respect to a direction parallel with a drawn direction of the electrical wires, and a lock portion configured to engage with and lock a partner connector is provided between the pair of projection portions on the one end portion and the pair of projection portions on the other end portion.

According to this configuration, the positioning portions of the connector are shaped as grooves. For this reason, when multiple connectors are stacked, the groove-shaped positioning portions of the connectors reliably fit to rail members whose shape corresponds to the slide surfaces. Accordingly, the connectors can slide along the rail members in a stable state.

Also, according to this configuration, the hold target portions have the recession portions that are shaped as recessions into which holding tools fit. For this reason, the connector is held in a state where the holding tools fit into the recession portions. The hold target portions each also have the step portion that is arranged side-by-side with the recession portion in the height direction of the housing and has a level difference relative to the recession portion. For this reason, the connector is held by the holding tools whose shape corresponds to the level difference formed by the step portions, and the connector is thus stably held so as to not shift in the height direction.

Furthermore, according to this configuration, a pair of projection portions is provided on both the end portion on one side and the end portion on the other side of the housing in the direction parallel with the drawn direction of the electrical wires. Also, the lock portions configured to engage with and lock the partner connector are provided between the pair of projection portions on the one end portion and the pair of projection portions on the other end portion. In other words, the pairs of projection portions are respectively provided on the one end portion and the other end portion of the housing, and the lock portions are provided between the pairs of projection portions so as to engage with the partner connector. For this reason, in the connector the lock portions engage with the partner connector at or near the center of gravity between the two end portions of the housing, thus making it possible to more reliably maintain a more stable and firm connected state.

Note that the above and other objects, features, and advantages of the present invention will become apparent by reading the following description with the attached drawings.

DETAILED DESCRIPTION OF THE INVENTION

The following describes an embodiment of the present invention with reference to the drawings. The present invention is widely applicable to various applications as a connector for connecting multiple electrical wires to a connection target member. In the present embodiment, a substrate serves as the connection target member to which electrical wires are connected by the connector, and the substrate constitutes a portion of a backlight device that is attached to a liquid crystal panel of a liquid crystal display device and is for emitting light onto the liquid crystal panel, for example.

Figure 1:
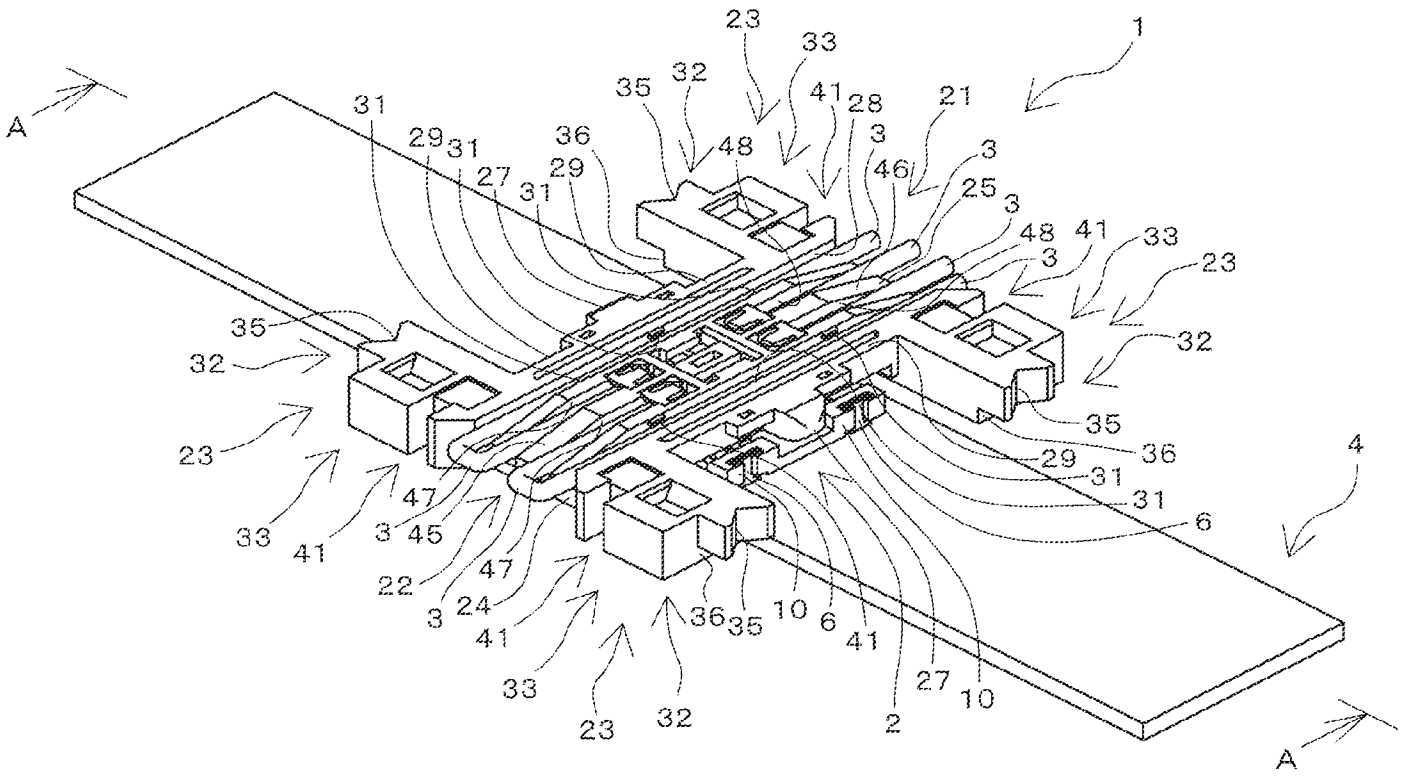
FIG. 1 is a perspective view of a connector according to an embodiment of the present invention along with a partner connector mounted on a substrate, and shows a state where the connector is connected to the partner connector.
Figure 2:
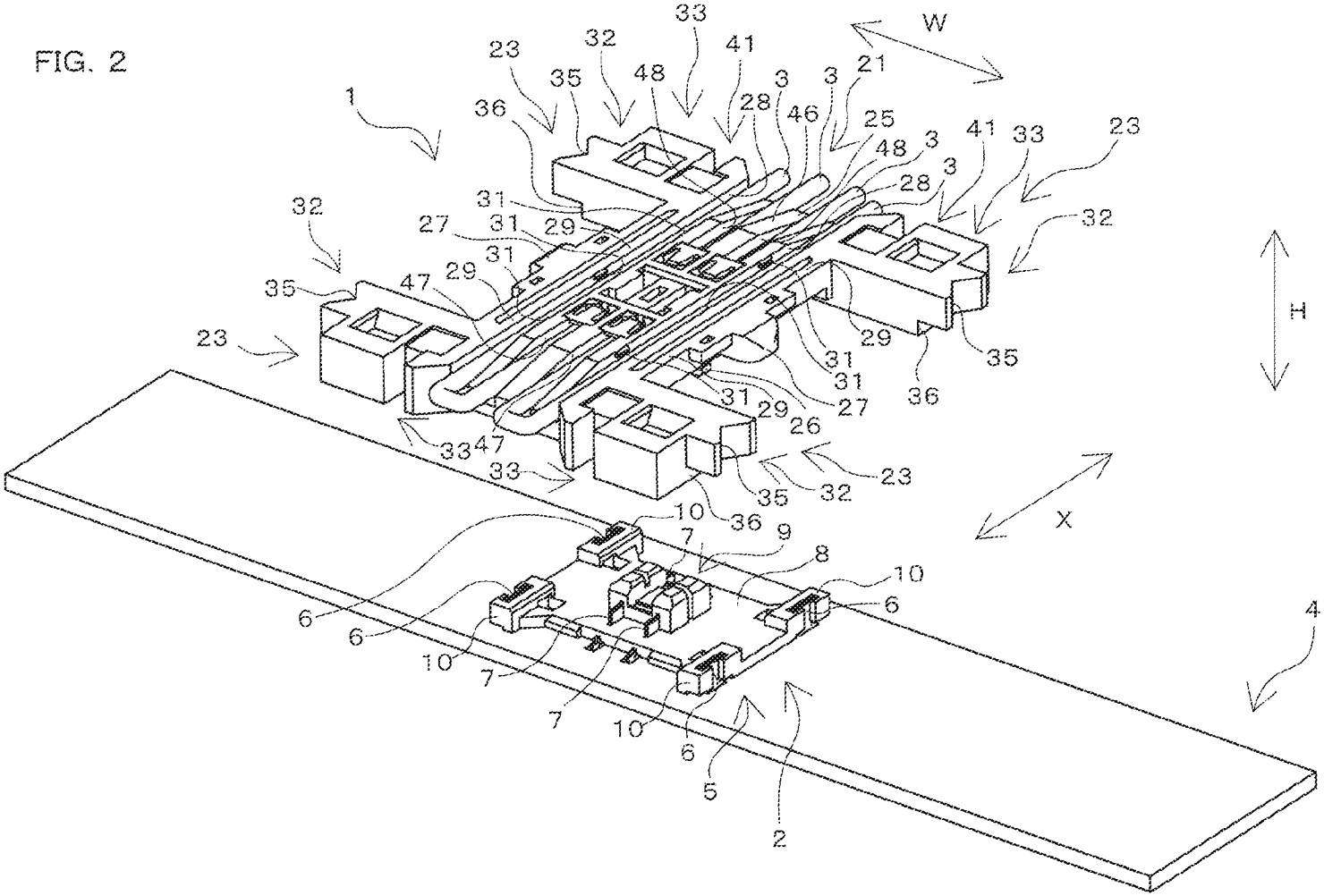
FIG. 2 is a perspective view of the connector shown in FIG. 1, and shows a state where the connector is detached from the partner connector.

FIG. 1 is a perspective view of a connector 1 according to one embodiment of the present invention along with a partner connector 2 mounted on a substrate, and shows a state where the connector 1 is connected to the partner connector 2. FIG. 2 is a perspective view of the connector 1 shown in FIG. 1, and shows a state where the connector 1 is detached from the partner connector 2.

Figure 5:
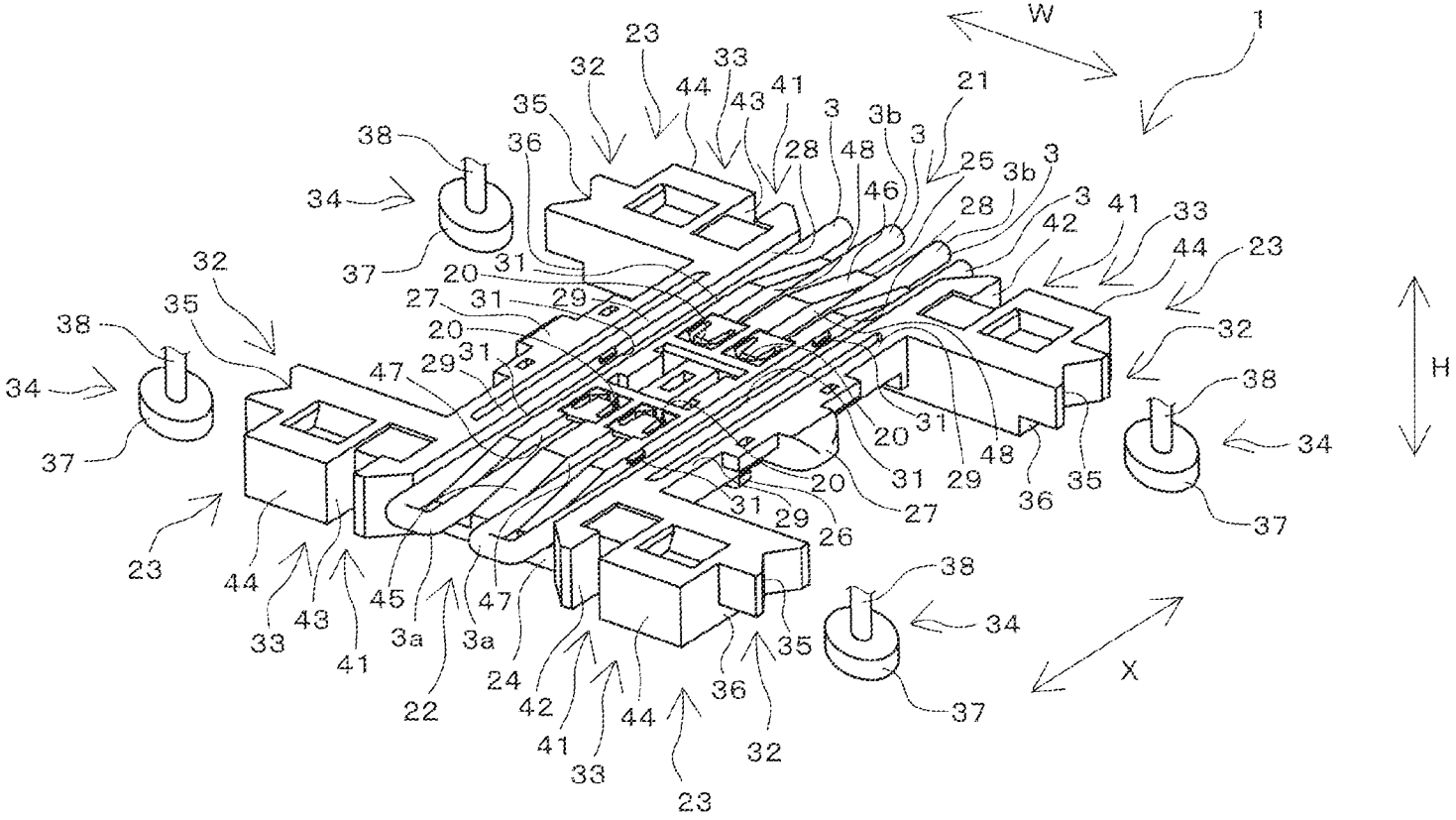
FIG. 5 is a perspective view of the connector shown in FIG. 1 along with holding tools.

In the following description, a width direction W of the connector 1 is simply the width direction W and the direction perpendicular to the width direction W of the connector 1 is simply called a front-rear direction X. As shown in FIGS. 2 and 5, in the present embodiment, the front side in the front-rear direction X of the connector 1 is the side on which first electrical wires 3*a*, which are drawn out and extend in a straight line from later-described first terminals 50, are drawn out, and the rear side in the front-rear direction X is the side on which second electrical wires 3*b*, which are drawn out and extend in a straight line from later-described second terminals 51, are drawn out. Also, the side of the connector 1 on which the connector 1 faces the partner connector 2 is the lower side, and the side opposite thereto is the upper side. Furthermore, a height direction is the thickness direction of the connector 1, a later-described housing 21, and the partner connector 2.

The connector 1 is a device for connecting electrical wires 3 to a connection target member, and in the present embodiment, the connector 1 is for connecting electrical wires 3 to a substrate 4, which is the connection target member, by being connected to a partner connector 2 mounted on the substrate 4. When the connector 1 is connected to the partner connector 2 (hereinafter, called the connected state), the electrical wires 3 are electrically connected to the substrate 4. The connector 1 of the present embodiment is configured to be connected to multiple electrical wires 3, and more specifically is configured to be connected to two first electrical wires 3*a* and two second electrical wires 3*b* that make up the plurality of electrical wires 3. The first electrical wires 3*a* are connected to later-described first terminals 50 and then drawn out, and the second electrical wires 3*b* are connected to later-described second terminals 51 and then drawn out.

Before the connector 1 of the present embodiment is described in further detail, the following first describes the partner connector 2 to which the connector 1 is connected, with reference to FIGS. 1 to 4.

Figure 3:
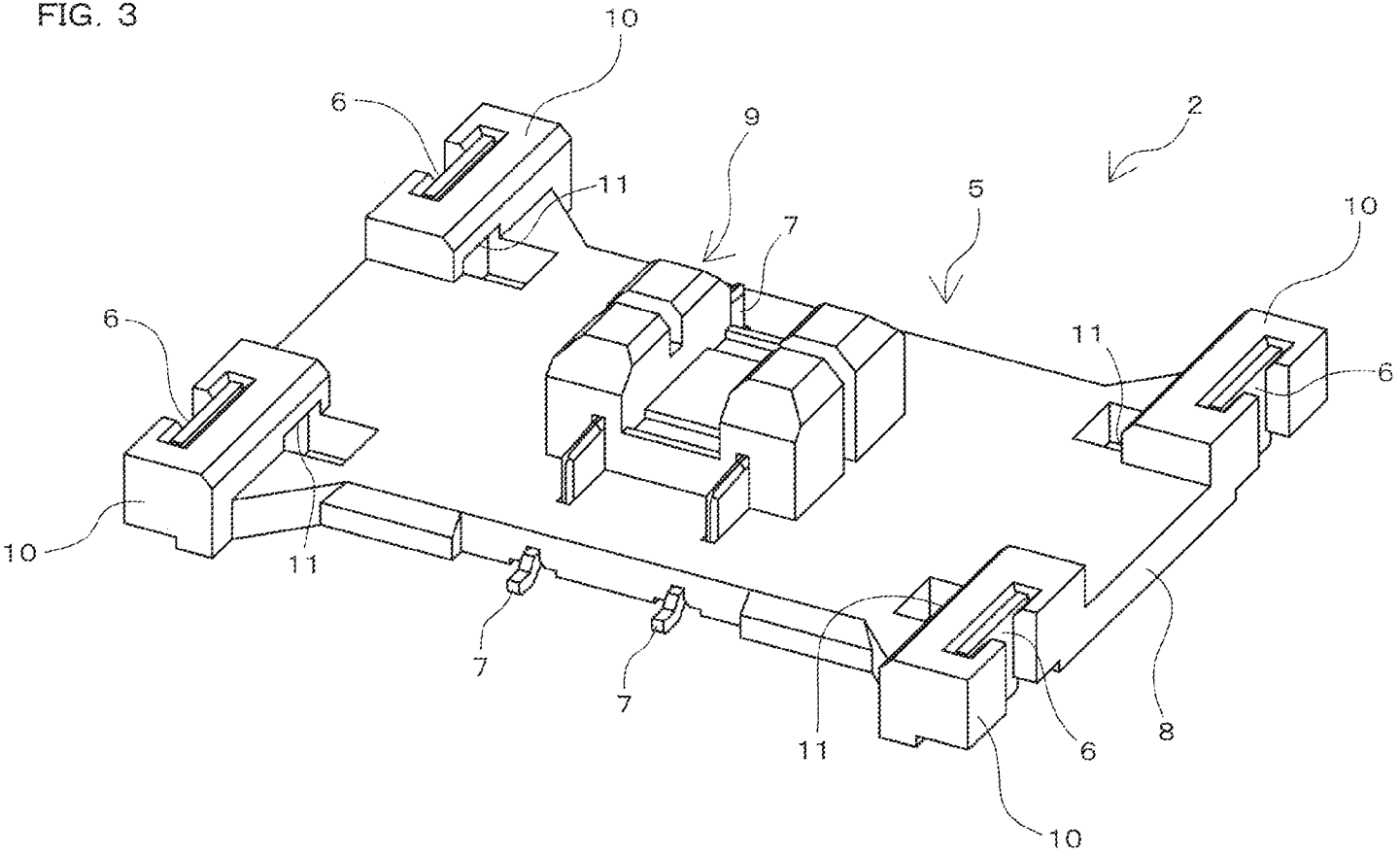
FIG. 3 is a perspective view of the partner connector shown in FIG. 1.
Figure 4:
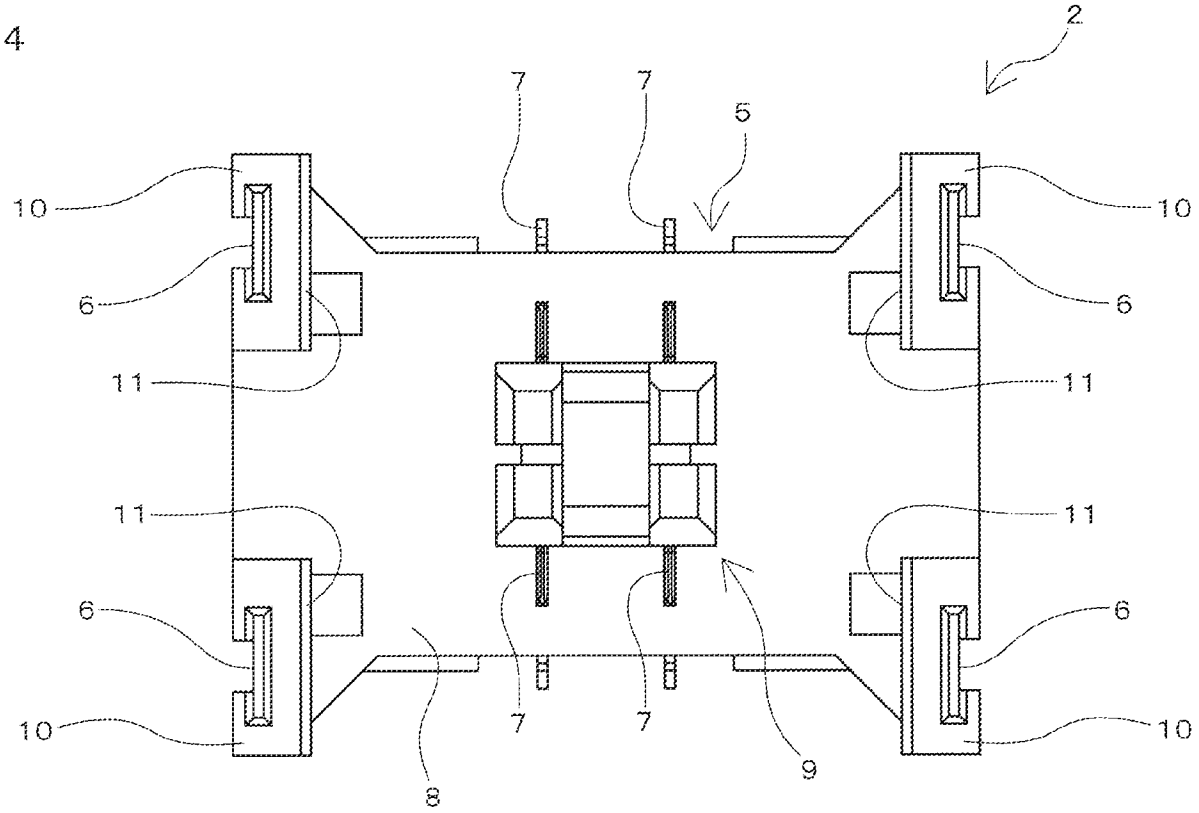
FIG. 4 is a plan view of the partner connector shown in FIG. 1.

FIG. 3 is a perspective view of the partner connector 2 shown in FIG. 1. FIG. 4 is a plan view of the partner connector 2 shown in FIG. 1.

The partner connector 2 is mounted on the substrate 4, on which an LED (Light Emitting Diode, not shown) is mounted. The partner connector 2 is configured as a part for mechanically and electrically connecting the connector 1 to the substrate 4. As shown in FIGS. 1 and 2, the partner connector 2 is provided in an approximately central portion of the substrate 4. The partner connector 2 includes a partner housing 5, tabs 6, and multiple partner terminals 7.

The partner housing 5 is configured as a portion into which the connector 1 is fitted. As shown in FIGS. 3 and 4, the partner housing 5 includes a base portion 8, a base projection portion 9, tab housing portions 10, and groove portions 11.

The base portion 8 is approximately plate-shaped. The base portion 8 is arranged on the upper surface of the substrate 4.

The base projection portion 9 is provided as a portion for positioning the connector 1 relative to the partner connector 2. The base projection portion 9 is provided in an approximately central portion of the partner connector 2. The base projection portion 9 guides the connector 1 so as to be fitted at an appropriate position on the partner connector 2.

The tab housing portions 10 are configured as portions for fixing the partner connector 2 to the substrate 4.

The groove portions 11 are configured as groove-shaped portions for connection of the connector 1. Later-described lock portions 26 are locked to the groove portions 11. The groove portions 11 are provided at four locations in the partner connector 2. The groove portions 11 are formed as grooves in inward side surfaces of the tab housing portions 10.

The tabs 6 are provided as members for fixing the partner connector 2 to the substrate 4. Leading end portions of the tabs 6 that protrude from the lower surfaces of the tab housing portions 10 are press-fitted into the substrate 4 so as to be fixed thereto.

The partner terminals 7 are configured as portions to which later-described terminals 20 of the connector 1 are connected. The partner terminals 7 are held by the partner housing 5, and are mechanically and electrically connected to the substrate 4. The partner terminals 7 are plate-shaped, and are provided so as to be partially exposed from the base projection portion 9 of the partner connector 2.

The following describes the connector 1 of the present embodiment.

Figure 6:
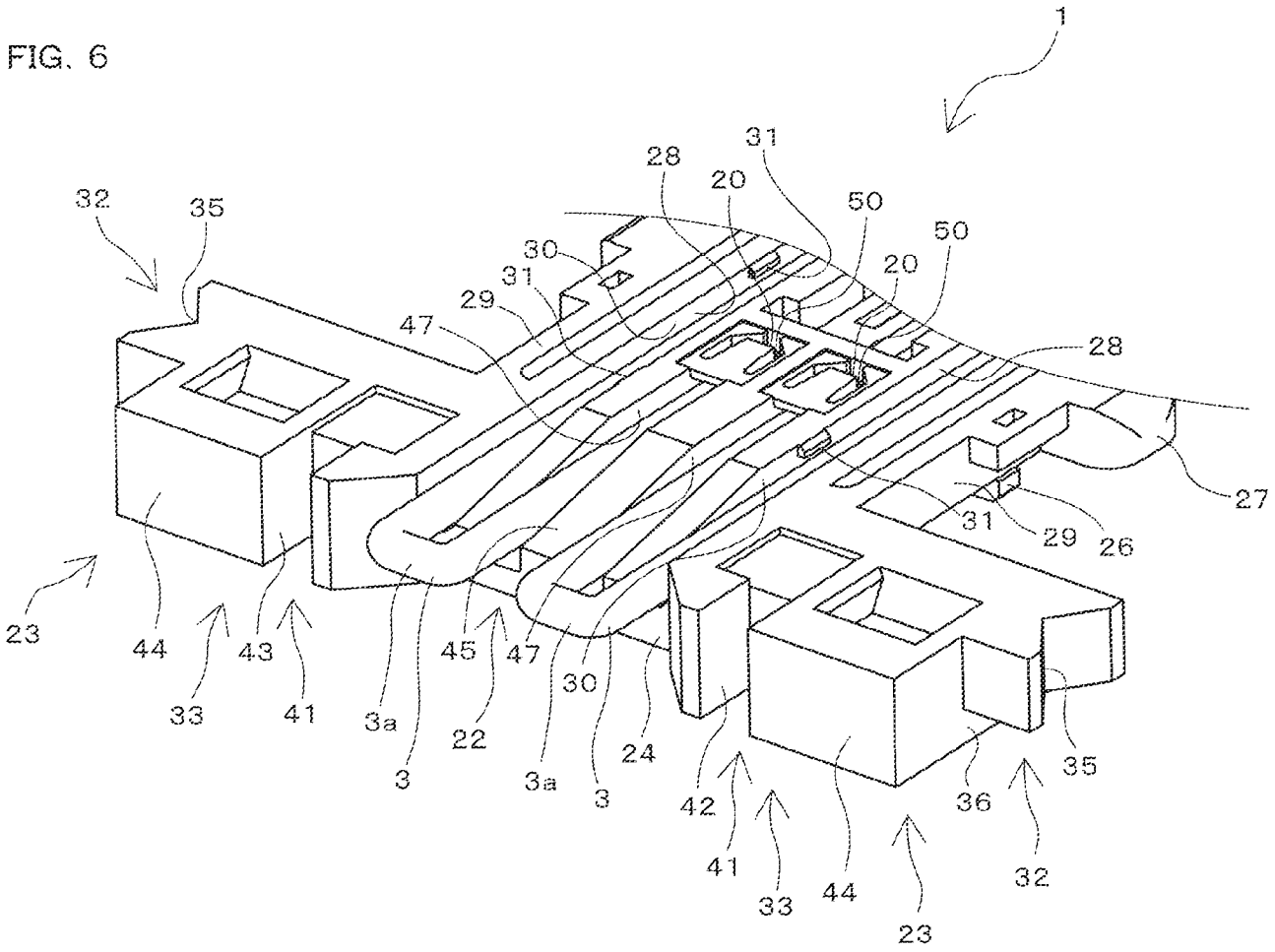
FIG. 6 is an enlarged view of a front portion of the connector shown in FIG. 5.
Figure 7:
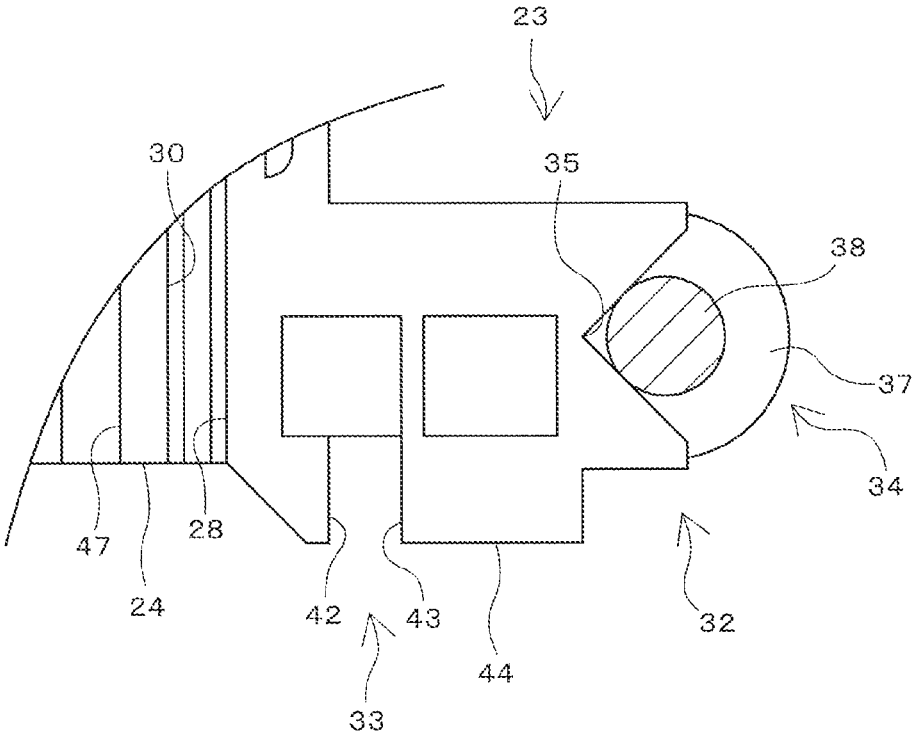
FIG. 7 is an enlarged view of a hold target portion of the connector shown in FIG. 1 along with a holding tool.
Figure 8:
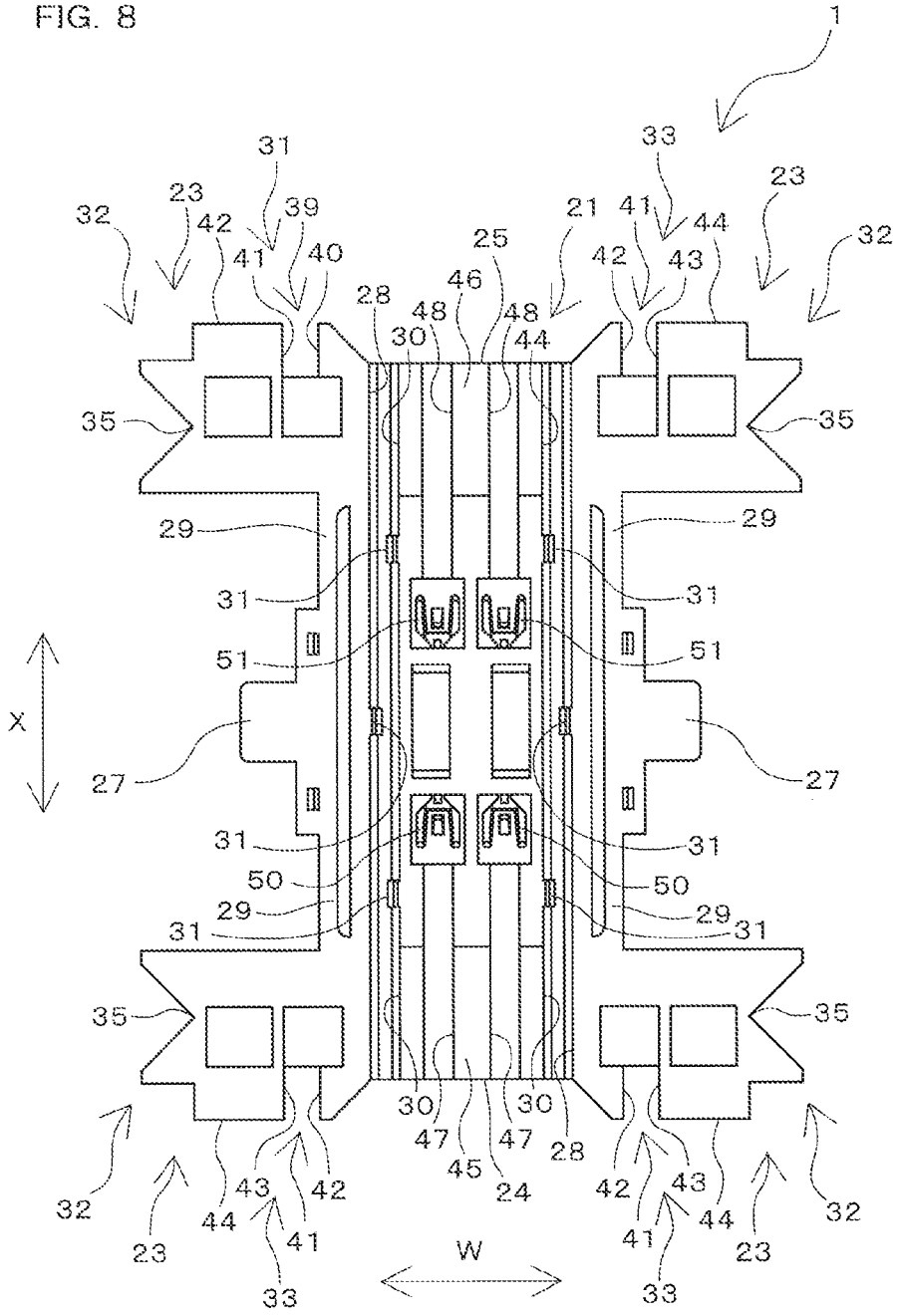
FIG. 8 is a plan view of the connector shown in FIG. 1, and shows a state where the connector is connected to the partner connector.
Figure 9:
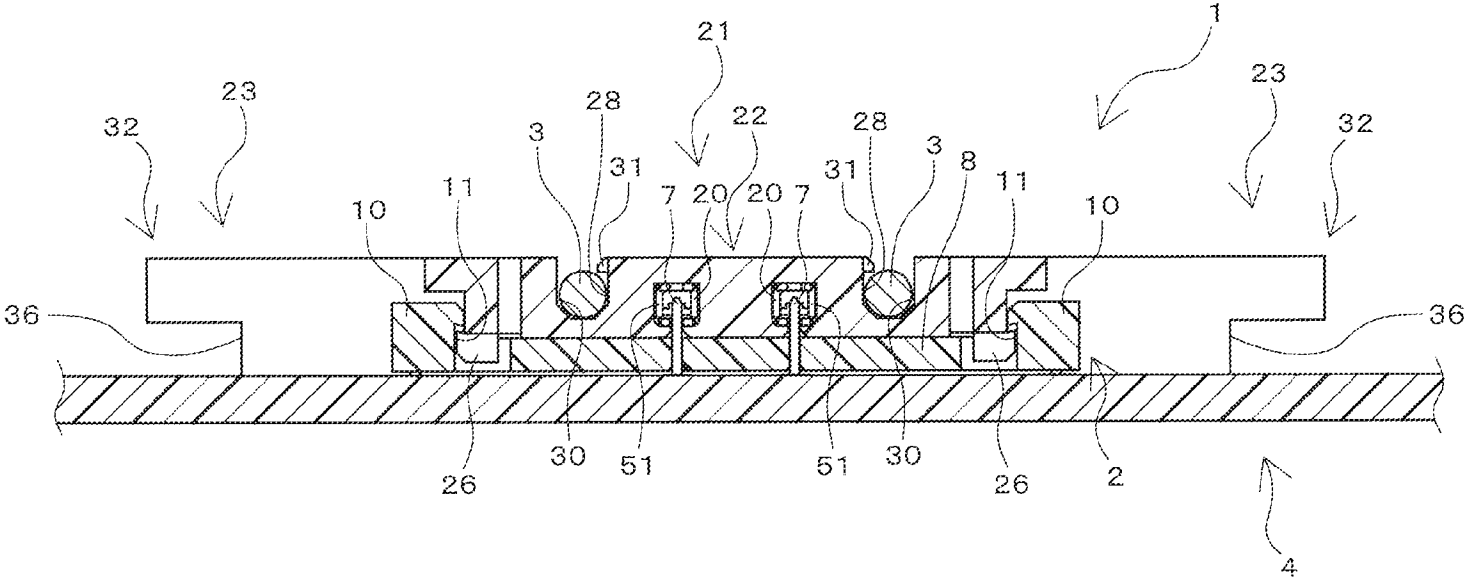
FIG. 9 is a cross-sectional view of the connector shown in FIG. 1, taken along an arrow line A-A.

FIG. 5 is a perspective view of the connector 1 shown in FIG. 1 along with later-described holding tools 34. FIG. 6 is an enlarged view of a front portion of the connector 1 shown in FIG. 5. FIG. 7 is an enlarged view of a hold target portion 32 of the connector 1 shown in FIG. 1 along with a holding tool 34. FIG. 8 is a plan view of the connector 1 shown in FIG. 1, and shows a state where the connector 1 is connected to the partner connector 2. FIG. 9 is a cross-sectional view of the connector 1 shown in FIG. 1, taken along an arrow line A-A.

The connector 1 is a device for electrically connecting the electrical wires 3 to the substrate 4, which is the connection target member. More specifically the connector 1 is connected to the partner connector 2 that is mounted on the substrate 4. The connector 1 includes multiple terminals 20 and a housing 21.

The terminals 20 are portions that come into contact with and are electrically connected to the partner terminals 7. The terminals 20 are held in the later-described housing 21. The terminals 20 are arranged in an approximately central portion of the connector 1. Four terminals 20 are provided in the connector 1 of the present embodiment. An electrical wire 3 is connected to each of the terminals 20.

As shown in FIGS. 1, 2, 5, 6, and 8, the terminals 20 include multiple first terminals 50 and multiple second terminals 51. Specifically the connector 1 includes multiple first terminals 50 and multiple second terminals 51 as the terminals 20. The first terminals 50 and the second terminals 51 are held by the housing 21.

As shown in FIG. 8, the first terminals 50 and the second terminals 51 are arranged side-by-side along the width direction W of the housing 21. In the present embodiment, two first terminals 50 are arranged side-by-side in the width direction W of the housing 21. Similarly, two second terminals 51 are arranged side-by-side along the width direction W of the housing 21.

Also, the first terminals 50, which are arranged side-by-side along the width direction W of the housing 21, and the second terminals 51, which are arranged side-by-side along the width direction W are arranged on the housing 21 so as to be side-by-side with each other along the front-rear direction X that is perpendicular to the width direction W of the housing 21. In the present embodiment, the first terminals 50 are arranged on the front side in the front-rear direction X of the housing 21. Also, the second terminals 51 are arranged on the rear side in the front-rear direction X of the housing 21.

The first terminals 50 are each configured to be connected to a first electrical wire 3*a*, and the second terminals 51 are each configured to be connected to a second electrical wire 3*b*. The connector 1 is configured such that the first electrical wires 3*a* connected to the first terminals 50 are drawn out from the first terminals 50 to one side in the front-rear direction X of the housing 21. The connector 1 is also configured such that the second electrical wires 3*b* connected to the second terminals 51 are drawn out from the second terminals 51 to the other side in the front-rear direction X of the housing 21. In the present embodiment, the first electrical wires 3*a* connected to the first terminals 50 are drawn out to the front side of the housing 21. The second electrical wires 3*b* connected to the second terminals 51 are drawn out to the rear side of the housing 21.

The housing 21 holds the terminals 20 that are connected to the electrical wires 3. The housing 21 includes a housing main body portion 22 and pairs of projection portions 23. The pairs of projection portions 23 are respectively provided at the front and rear ends in the front-rear direction X of the housing 21.

The housing main body portion 22 is configured as the main body portion of the connector 1. As shown in FIG. 5, the housing main body portion 22 holds the terminals 20 that are connected to the electrical wires 3. In the connected state, the housing main body portion 22 is arranged between the tab housing portions 10 of the partner connector 2, which are arranged on the outward sides in the width direction W of the connector 1. The housing main body portion 22 includes lock portions 26, lock operation portions 27, electrical wire holding portions 28, and lock support portions 29.

As shown in FIGS. 5, 6, and 9, in the connected state, the lock portions 26 are arranged between the pair of projection portions 23 in the end portion of the housing 21 on one side in a direction parallel with the drawn direction of the electrical wires 3 and the pair of projection portions 23 in the end portion on the other side. The lock portions 26 are configured as portions for engaging with and locking the partner connector 2. The lock portions 26 are provided between the later-described pairs of projection portions provided on the front and rear sides of the connector 1. More specifically, as shown in FIGS. 5 and 9, the lock portions 26 are provided in the central portion, with respect to the front-rear direction X, of the surface of the connector 1 on the side for connection to the partner connector 2, and are configured to engage with the groove portions 11 of the partner connector 2.

The lock operation portions 27 are provided as portions for disengaging the lock portions 26 that are engaged with the groove portions 11. When the lock operation portions 27 are pressed, the lock portions 26 become displaced in the width direction W of the housing 21. The lock operation portions 27 are respectively arranged on two end portions of the housing 21 in the width direction W at positions in the approximately central portion in the front-rear direction X.

The electrical wire holding portions 28 are configured to hold portions of the electrical wires 3 drawn out from the housing 21 in the front-rear direction X. For example, as shown in FIG. 5, the electrical wire holding portions 28 are configured to hold portions other than the end portions of electrical wires 3 (first electrical wires 3*a*) that are connected to terminals 20 (first terminals 50) and are drawn out and extend from the terminals 20 (first terminals 50), the held portions being portions that extend from bent portions of the electrical wires 3 (first electrical wires 3*a*) that are drawn out and extend from the terminals 20 (first terminals 50). In the present embodiment, the bent portions of these electrical wires 3 are configured as portions of the electrical wires 3 that are first drawn out forward from the first terminals 50 and then turn and extend rearward. In the bent portions of the electrical wires 3, the electrical wires 3 are first drawn out forward from the first terminals 50, then bend and extend along the width direction, and then bend again and extend rearward along the front-rear direction X. The electrical wire holding portions 28 hold the portions that extend after the bend toward the side opposite to the drawn direction side in the front-rear direction X of the housing 21.

Figure 10:
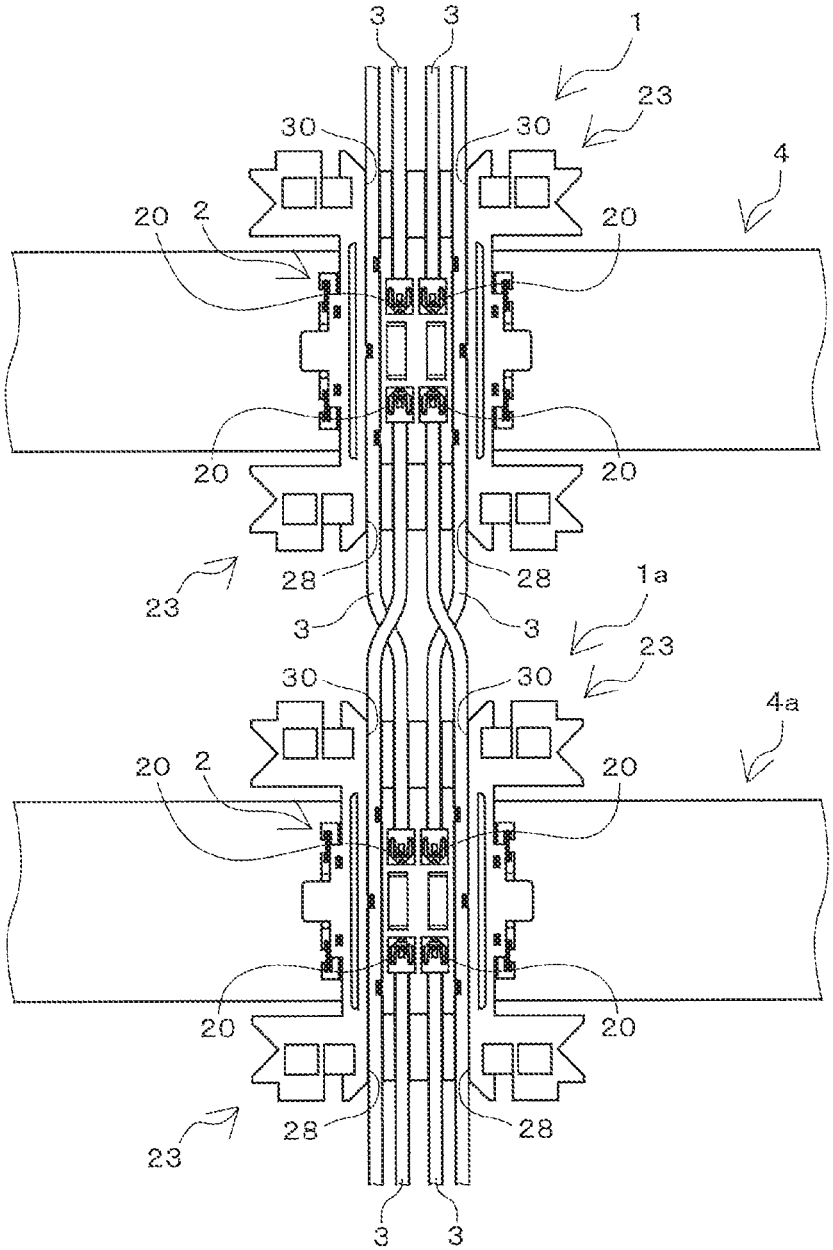
FIG. 10 is a diagram showing an example of an aspect in which electrical wire holding portions of one connector hold electrical wires extending from another connector.

FIG. 10 is a diagram showing an example of an aspect in which the electrical wire holding portions 28 of one connector 1 hold electrical wires 3 extending from another connector 1*a*. FIG. 10 shows a state where the connector 1 is arranged side-by-side with the other connector 1*a* whose configuration is similar to that of the connector 1. The other connector 1*a* is configured to be connected to a substrate 4*a*. Note that due to having a configuration similar to that of the connector 1, portions of the other connector 1*a* shown in FIG. 10 are denoted by the same reference signs as the connector 1.

As shown in FIG. 10, the electrical wire holding portions 28 may be configured to hold portions, other than end portions, of electrical wires 3 that are connected to and drawn out and extend from the other connector 1*a* that is different from the connector 1. For example, as shown in FIG. 10, the electrical wire holding portions 28 are configured such that, in the case where two connectors (1 and 1*a*) are arranged side-by-side, electrical wire holding portions 28 of the one connector 1 hold portions of electrical wires 3 that are drawn out and extend from the other connector 1*a*. Specifically FIG. 10 shows an aspect in which the electrical wire holding portions 28 of each of the two connectors 1 and 1*a* hold portions of electrical wires 3 that are drawn out and extend from the other connector. Note that the electrical wire holding portions 28 may hold portions of electrical wires 3 that are drawn out and extend from a connector other than the illustrated connectors. Also, the portions of electrical wires 3 that are drawn out and extend from the other connector 1*a* and held in the electrical wire holding portions 28 may be the portions that are drawn out from and extend in a straight line from the terminals 20. In other words, the electrical wire holding portion 28 may hold portions of the electrical wires 3 that are drawn out from the other connector 1*a* and extend before the bent portion.

The electrical wire holding portions 28 are configured as holding grooves 30 that are shaped as grooves into which the electrical wires 3 are fitted. The electrical wire holding portions 28 are provided on both sides in the width direction W of the housing main body portion 22. The electrical wire holding portions 28 provided on the respective sides in the width direction W of the housing main body portion 22 are arranged parallel with each other.

The lock support portions 29 are configured as portions that support the lock portions 26 and the lock operation portions 27 such that the lock portions 26 can become displaced in the width direction W of the housing 21 when the lock operation portions 27 are pressed. The lock support portions 29 are provided so as to span the two width direction W sides of the housing 21 in the front-rear direction X. The lock support portions 29 are configured so as to be capable of elastic deformation in the width direction W The lock support portions 29 are arranged outward of the electrical wire holding portions 28 in the width direction W.

The holding grooves 30 are provided so as to extend in a direction parallel with the direction in which the electrical wires 3 connected to the terminals 20 are drawn out. The holding grooves 30 each have projections 31.

The projections 31 are provided as portions for preventing the electrical wires 3 fitted into the holding grooves 30 from moving out of the holding grooves 30. The projections 31 are provided on inward surfaces of the holding grooves 30. The projections 31 are provided on both width direction W sides of the opening portion of each of the holding grooves 30. Each of the holding grooves 30 is provided with multiple projections 31 along the front-rear direction X of the housing main body portion 22.

As shown in FIGS. 5 to 9, the pairs of projection portions 23 are portions that are held by holding tools 34, which are for holding the connector 1 when being individually transported, and the pairs of projection portions 23 are configured as portions that are bound when multiple connectors 1 are transported in a stacked state. The holding tools 34 of the present embodiment are configured as portions for gripping the connector 1, and more specifically are leading end portions of a robot arm (not shown) that is used as a mechanism for transporting the connector 1. The pairs of projection portions 23 are provided so as to protrude from the housing main body portion 22. The pairs of projection portions 23 that protrude from the housing main body portion 22 extend toward respective sides in the direction perpendicular to the direction in which the electrical wires 3 are drawn out from the terminals 20 held by the housing main body portion 22. Furthermore, the pairs of projection portions 23 are respectively provided on one end portion and the other end portion of the housing 21 with respect to a direction parallel to the drawn direction of the electrical wires 3. In other words, the pairs of projection portions 23 are respectively provided on the front side and the rear side of the connector 1 in the front-rear direction X, and respectively project outward to the two sides in the width direction W of the housing 21, Each of the projection portions 23 includes a hold target portion 32 and a positioning portion 33.

The hold target portions 32 are portions that are held by the holding tools 34 for holding the connector 1 when the connector 1 is individually transported. The hold target portions 32 each include a recession portion 35 and a step portion 36. Note that the holding tools 34 are devices for holding and moving the connector 1 when transporting the connector 1 or when connecting the connector 1 to the partner connector 2. Each of the holding tools 34 includes a connector holding portion 37 and a shaft portion 38.

The connector holding portions 37 are portions for holding the connector 1 by supporting the connector 1 from below while also sandwiching it in the width direction. W. As shown in FIGS. 5 and 7, the connector holding portions 37 are disc-shaped and have a larger diameter than the later-described shaft portions 38. More specifically, the connector holding portions 37 hold the connector 1 in a manner of sandwiching the later-described step portions 36 in the width direction W.

The shaft portions 38 are portions for holding the connector 1 while also positioning the connector 1 at an appropriate position relative to the holding tools 34. The shaft portions 38 are shaped as circular columns. The connector holding portions 37 are supported at leading end portions of the shaft portions 38. More specifically the shaft portions 38 hold the connector 1 in a manner of sandwiching the later-described recession portions 35 in the width direction W. In other words, the shaft portions 38 hold the connector 1 by sandwiching it in conjunction with the connector holding portions 37. The shaft portions 38 may rotatably support the connector holding portions 37.

As shown in FIGS. 5 and 7, the recession portions 35 are configured as portions that are gripped by the shaft portions 38 of the holding tools 34 when the connector 1 is held. The recession portions 35 are shaped as recessions into which the holding tools 34 are fitted. The recession portions 35 of the present embodiment are formed in leading end portions of the pairs of projection portions 23 on the two sides in the width direction W The recession portions 35 of each pair of projection portions 23 are configured to be open outward in the width direction W of the housing 21. More specifically the recession portions 35 are each constituted by two flat inclined surfaces. When the connector 1 is held by the holding tools 34, the shaft portions 38 are in line contact with two locations on the recession portions 35.

Because the recession portions 35 of the present embodiment are each constituted by two inclined surfaces so as to be open outward, the shaft portions 38 guide the recession portions 35 to appropriate positions even if the recession portions 35 are out of alignment before being sandwiched by the shaft portions 38. Specifically, due to the recession portions 35 each being constituted by two flat inclined surfaces so as to be open outward, when the connector 1 is held by the holding tools 34, the connector 1 becomes positioned at an appropriate position relative to the holding tools 34.

The step portions 36 are configured as portions for preventing the connector 1 from shifting in the height direction H of the housing 21 when the connector 1 is held by the holding tools 34. The step portions 36 are arranged side-by-side with the recession portions 35 in the height direction H of the housing 21, and have a level difference relative to the recession portions 35. Specifically, the recession portions 35 are placed on the upper surfaces of the connector holding portions 37 when the connector 1 is held by the holding tools 34. For this reason, the connector 1 is supported by the connector holding portions 37 from below at the step portions 36 so as to not fall.

Note that it is desirable for connectors 1 to be transported in a group in order to improve the efficiency of transportation of the connectors 1, and in the present embodiment, multiple connectors 1 are stacked in the height direction H when transported. Here, rail members 39 and binding members 40 are used in order to accurately stack the connectors 1.

Figure 11:
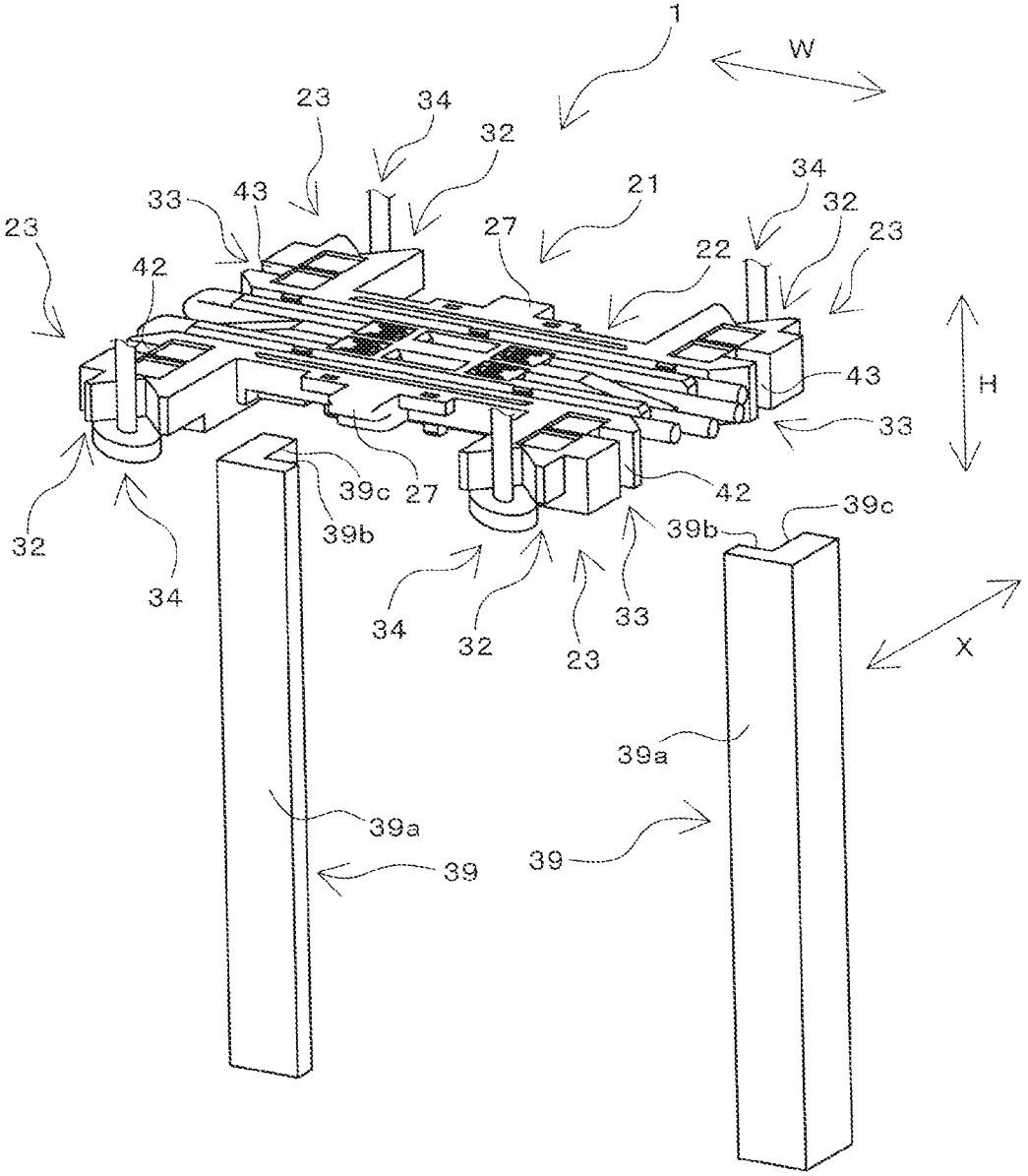
FIG. 11 is a perspective view of a state where connectors are stacked along rail members.
Figure 12:
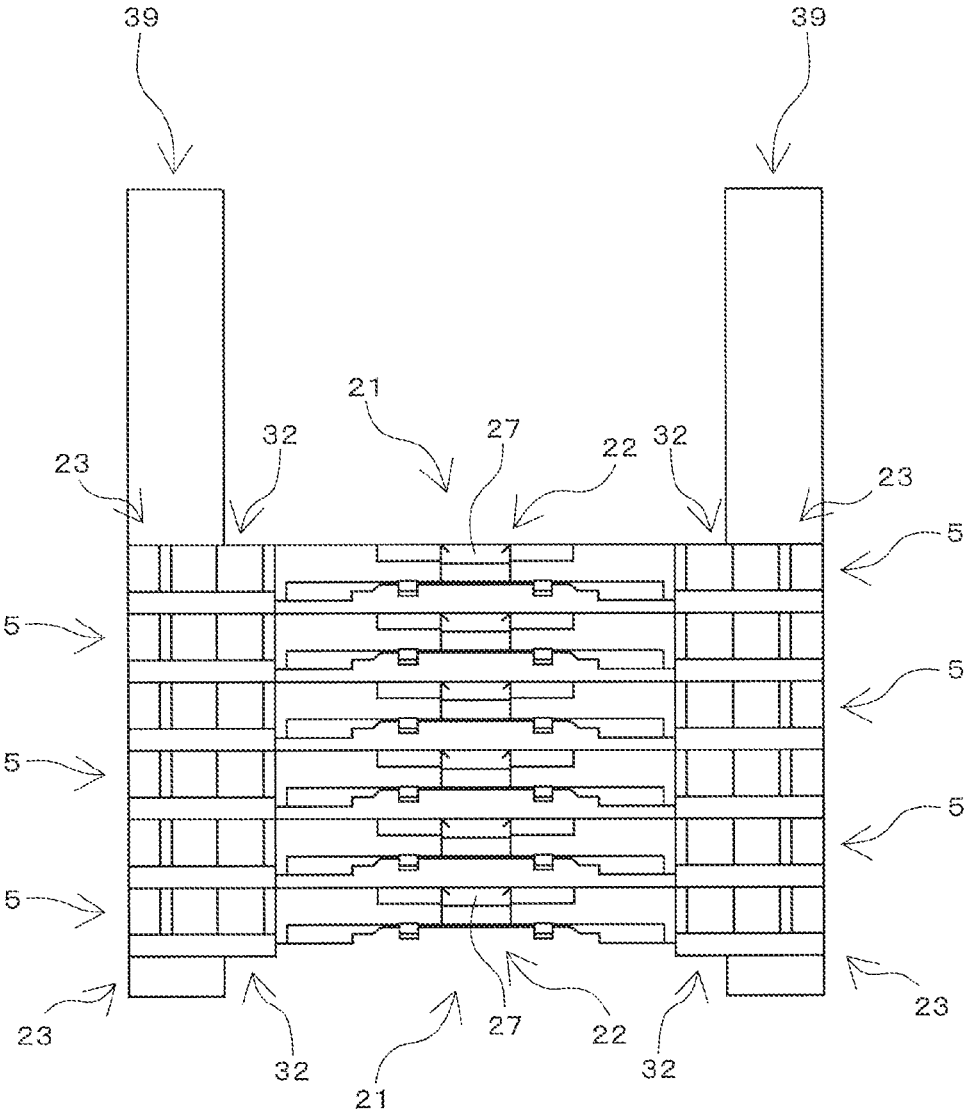
FIG. 12 is a front view of the connectors and the rail members shown in FIG. 11.
Figure 13:
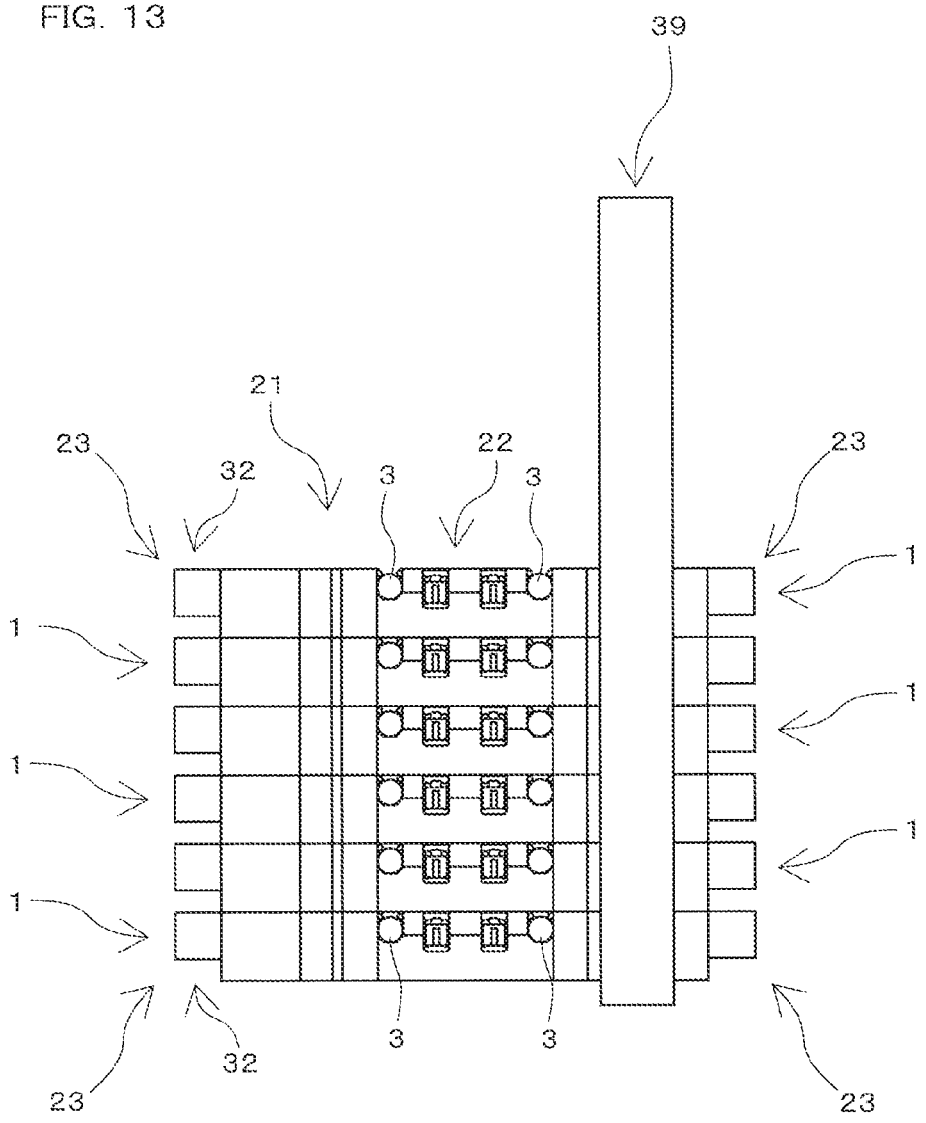
FIG. 13 is a side view of the connectors and the rail members shown in FIG. 11.
Figure 14:
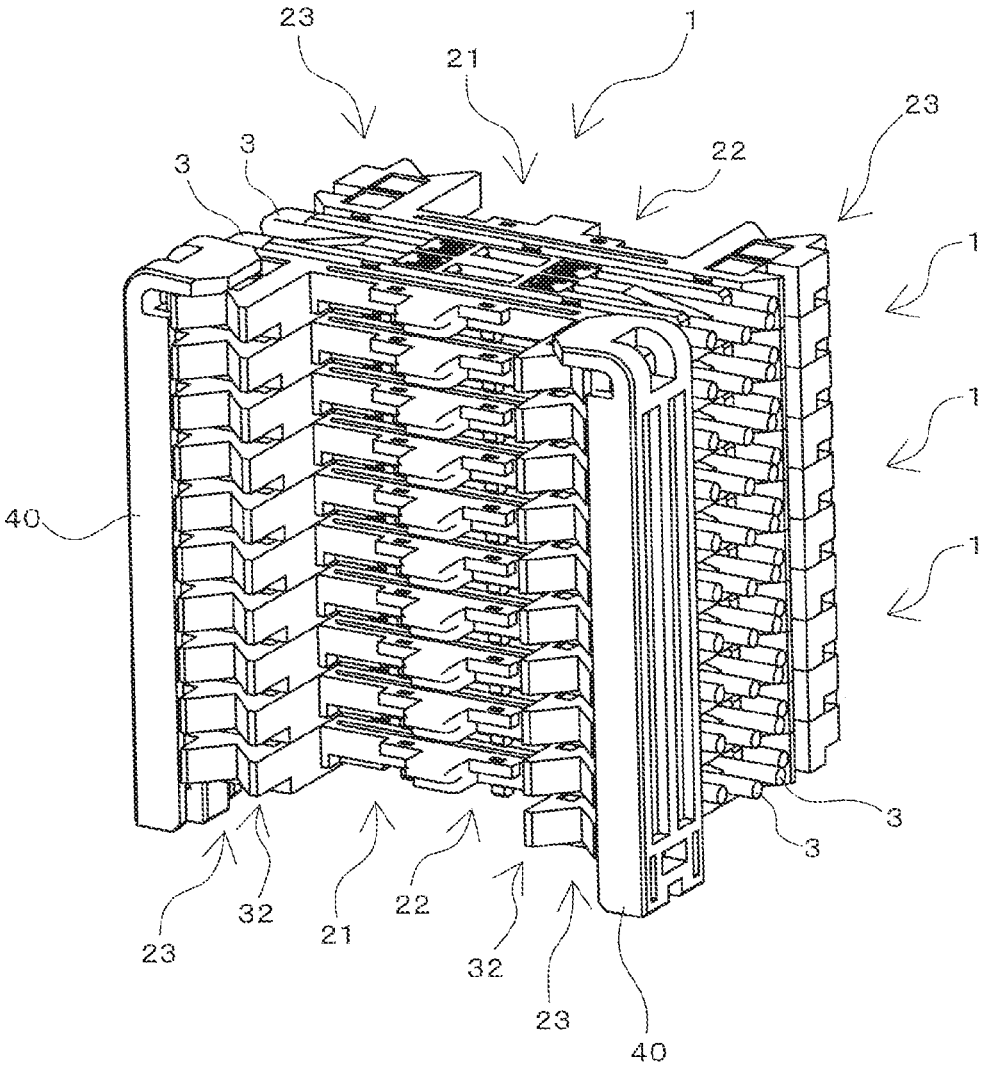
FIG. 14 is a perspective view of a state where stacked connectors are bound by binding members.

FIG. 11 is a perspective view of a state where connectors 1 are stacked along rail members 39. FIG. 12 is a front view of the connectors 1 and the rail members 39 shown in FIG. 11. FIG. 13 is a side view of the connectors 1 and the rail members 39 shown in FIG. 11. FIG. 14 is a perspective view of a state where the stacked connectors 1 are bound by binding members 40.

As shown in FIGS. 11 to 13, the rail members 39 are members used in order to prevent shifting of the connectors 1 relative to each other when the connectors 1 are stacked in the height direction H. The rail members 39 are arranged in pairs, and are arranged parallel to each other in the height direction H of the connector 1, for example. The connectors 1 are lifted up and transported while being individually sandwiched from the two width direction W sides by the holding tools 34 of the robot arm. The connectors 1, which are gripped by the holding tools 34 and individually transported, are released at a position corresponding to the region above the pair of rail members 39 so as to fit between the rail members 39. After being released at the position corresponding to the rail members 39, the connectors 1 descend along the rail members 39 from above the rail members 39. As shown in FIGS. 12 and 13, the connectors 1 that have descended along the rail members 39 become stacked without gaps along the rail members 39. The connectors 1 stacked along the rail members 39 form a compact group. The connectors 1 are then bound by the binding members 40 in the stacked state.

Note that the connectors 1 are configured to slide along later-described slide surfaces 41 when descending along the rail members 39. The rail members 39 include housing-opposing surfaces 39*a* that oppose the housing main body portion 22 and extend inward in the direction in which the pair of rail members 39 oppose each other, projection portion width direction surfaces 39*b* that oppose the side surfaces formed on the inward side in the width direction W of the pair of projection portions 23, and projection portion front-rear surfaces 39*c* that oppose the side surfaces formed on the outward side in the front-rear direction X of the pair of projection portions 23.

As shown in FIG. 14, the binding members 40 are members that are fixed to a group of connectors 1 stacked in the height direction H, and are for holding the connectors 1 in the stacked state. In the present embodiment, the stacked connectors 1 are bound by two binding members 40 that oppose each other. Also, the stacked connectors 1 are bound on both sides in the front-rear direction X of the connectors 1, that is to say are bound at one of the two projection portions 23 on the front side and one of the two projection portions 23 on the rear side, for example.

As shown in FIGS. 5, 8, and 11, the positioning portions 33 are portions configured for use when the connectors 1 are positioned, and more specifically are configured as portions that are positioned relative to the rail members 39 that guide the connectors 1 when the connectors 1 are being stacked. The positioning portions 33 are shaped as grooves. The positioning portions 33 are formed in the pairs of projection portions 23, and are portions configured for use when positioning the connectors 1 that are being stacked. The positioning portions 33 each have multiple slide surfaces 41.

The slide surfaces 41 are configured as surfaces that slide along the rail members 39 when the connectors 1 are being stacked. The slide surfaces 41 are provided in two end portions in the front-rear direction X of each of the connectors 1. The slide surfaces 41 include a first slide surface 42, a second slide surface 43, and a third slide surface 44.

The first slide surfaces 42 are provided as first surfaces that slide against the rail members 39 when the connectors 1 are being stacked. As shown in FIGS. 5, 8, 11, the first slide surfaces 42 are provided on inward surfaces in the width direction W of the housing main body portion 22. The first slide surfaces 42 are provided in end portions in the front-rear direction X of each of the connectors 1. The first slide surfaces 42 are configured to slide against the housing-opposing surfaces 39*a*.

The second slide surfaces 43 are provided as second surfaces that slide against the rail members 39 when the connectors 1 are being stacked. The second slide surfaces 43 are provided in end portions in the front-rear direction X of each of the connectors 1. The second slide surfaces 43 are provided on side surfaces of each of the pairs of projection portions 23. The second slide surfaces 43 are provided at positions that oppose the first slide surfaces 42. The first slide surfaces 42 and the second slide surfaces 43 form groove-shaped portions into which the rail members 39 can slidably fit. The second slide surfaces 43 are configured to slide against the projection portion width direction surfaces 39*b*.

The third slide surfaces 44 are provided as third surfaces that slide against the rail members 39 when the connectors 1 are being stacked. The third slide surfaces 44 are provided in end portions in the front-rear direction X of each of the connectors 1. The third slide surfaces 44 are provided on each of the pairs of projection portions 23. The third slide surfaces 44 are provided as end surfaces of the projection portions 23 that are perpendicular to the front-rear direction X. The third slide surfaces 44 are configured to slide against the projection portion front-rear surfaces 39*c*.

In order for the connectors 1 to be connected to substrates 4, the binding members 40 are removed from the compact group of connectors 1, and the connectors 1 are successively gripped and transported to the arrangement location. Specifically, the connectors 1 are lifted up one-by-one and transported while the hold target portions 32 are sandwiched from the two width direction W sides by the holding tools 34 of the robot arm.

As shown in FIGS. 1, 2, 5, and 8, the housing 21 includes a first support portion 24 and a second support portion 25, The first support portion 24 and the second support portion 25 are included in the housing main body portion 22. The first support portion 24 and the second support portion 25 are configured to support portions of the electrical wires 3. The first support portion 24 is configured to support portions of the first electrical wires 3*a* that are drawn out from the first terminals 50 in the state where the first electrical wires 3*a* are connected to the first terminals 50. The first support portion 24 has a plate-shaped configuration. The first support portion 24 is provided on one side of the housing 21 in the front-rear direction X. Specifically the first support portion 24 of the present embodiment is provided on the front side of the housing 21.

The second support portion 25 is configured to support portions of the second electrical wires 3*b* that are drawn out from the second terminals 51 in the state where the second electrical wires 3*b* are connected to the second terminals 51. The second support portion 25 has a plate-shaped configuration. The second support portion 25 is provided on the other side of the housing 21 in the front-rear direction X. Specifically the second support portion 25 of the present embodiment is provided on the rear side of the housing 21.

The first support portion 24 and the second support portion 25 are each arranged between a corresponding pair of projection portions 23. The first support portion 24 and the second support portion 25 of the present embodiment are respectively arranged in two end portions in the front-rear direction X of the housing 21. More specifically the first support portion 24 is arranged in the central portion in the width direction W between the pair of projection portions 23 arranged on the front side. The second support portion 25 is arranged in the central portion in the width direction W between the pair of projection portions 23 arranged on the rear side. The first support portion 24 is provided with a first inclined surface 45 and first guide grooves 47. Also, the second support portion 25 is provided with a second inclined surface 46 and second guide grooves 48.

The first inclined surface 45 is provided as an inclined surface for facilitating fitting the first electrical wires 3*a* into the later-described first guide grooves 47. The first inclined surface 45 is formed by providing the first support portion 24 such that the thickness thereof decreases toward one side in the front-rear direction X. In the present embodiment, the first inclined surface 45 is provided such that the thickness of the first support portion 24 decreases toward the front side. The first inclined surface 45 is formed at the upper faces of the first support portion 24.

The second inclined surface 46 is provided as an inclined surface for facilitating fitting the second electrical wires 3*b* into the later-described second guide grooves 48. The second inclined surface 46 is formed by providing the second support portion 25 such that the thickness thereof decreases toward one side in the front-rear direction X. In the present embodiment, the second inclined surface 46 is provided such that the thickness of the second support portion 25 decreases toward the rear side. The second inclined surface 46 is formed at the upper faces of the second support portion 25.

The first guide grooves 47 are configured as grooves into which drawn-out portions of the first electrical wires 3*a* connected to first terminals 50 are fitted. The first guide grooves 47 are provided in front of the first terminals 50. The first guide grooves 47 are provided as grooves that extend in the front-rear direction X in the first support portion 24. In the present embodiment, two first guide grooves 47 are provided in correspondence with the first terminals 50. The first guide grooves 47 are arranged parallel with each other.

The second guide grooves 48 are configured as grooves into which drawn-out portions of the second electrical wires 3*b* connected to second terminals 51 are fitted. The second guide grooves 48 are provided in front of the second terminals 51. The second guide grooves 48 are provided as grooves that extend in the front-rear direction X in the second support portion 25. In the present embodiment, two second guide grooves 48 are provided in correspondence with the second terminals 51. The second guide grooves 48 are arranged parallel with each other. The first guide grooves 47 and the second guide grooves 48 are arranged parallel with each other. The first guide grooves 47 and the second guide grooves 48 are arranged inward of the electrical wire holding portions 28 in the width direction W of the housing main body portion 22. The first guide grooves 47 and the second guide grooves 48 are arranged parallel with the electrical wire holding portions 28.

In the above-described connector 1, the electrical wires 3 are fitted into the housing 21 in the state where the terminals 20 have been crimped to the leading end portions of the electrical wires 3. After the electrical wires 3 are fitted into the housing 21, the portions of the electrical wires 3 drawn out from the terminals 20 are fitted into the first guide grooves 47 and the second guide grooves 48. Also, portions other than the end portions of the electrical wires 3 are held by the electrical wire holding portions 28. For example, the electrical wire holding portions 28 hold portions that extend from the bent portions of the electrical wires 3 that are drawn out and extend from the terminals 20, or the electrical wire holding portions 28 hold portions other than the end portions of electrical wires 3 that are drawn out and extend from the other connector 1*a*. The connector is then connected to the substrate 4 and fixed by the lock portions 26.

Effects of Embodiment

According to the connector 1 of the present embodiment, the first terminals 50 are arranged side-by-side along the width direction W of the housing 21, the second terminals 51 are arranged side-by-side along the width direction W of the housing 21, and in the housing 21, the first terminals 50, which are arranged side-by-side along the width direction W, are arranged side-by-side with the second terminals 51, which are arranged side-by-side along the width direction W, along the front-rear direction X of the housing 21 that is perpendicular to the width direction W. The first electrical wires 3*a* (electrical wires 3) are respectively connected to the first terminals 50 and are drawn out to one side in the front-rear direction X of the housing 21, and the second electrical wires 3*b* (electrical wires 3) are respectively connected to the second terminals 51 and are drawn out to the other side in the front-rear direction X of the housing 21. In other words, electrical wires 3 are not only arranged on one side of the housing 21 in the front-rear direction X, but also can be arranged on the other side of the housing 21 in the front-rear direction X. Accordingly, the electrical wires 3 can be drawn out to both the front and rear sides of the housing 21 along the front-rear direction X. As a result, the electrical wires 3 can be arranged densely in the connector 1.

Therefore, according to the present embodiment, it is possible to provide the connector 1 in which electrical wires 3 can be arranged densely.

According to the connector 1 of the present embodiment, the housing 21 includes the first support portion 24 and the second support portion 25 that are plate-shaped. The first support portion 24 is configured to support portions of the first electrical wires 3*a* (electrical wires 3) that are drawn out from the first terminals 50 (terminals 20) when the first electrical wires 3*a* (electrical wires 3) are connected. Also, the second support portion 25 is configured to support portions of the second electrical wires 3*b* (electrical wires 3) that are drawn out from the second terminals 51 (terminals 20) when the second electrical wires 3*b* (electrical wires 3) are connected. For this reason, the portions of the electrical wires 3 that are drawn out from the terminals 20 can be prevented from bending so as to sag downward, for example. Accordingly, the portions of the electrical wires 3 that are drawn out from the terminals 20 can be protected.

According to the connector 1 of the present embodiment, portions of the first electrical wires 3*a* (electrical wires 3) that are drawn out from the first terminals 50 are fitted into the first guide grooves 47, and portions of the second electrical wires 3*b* (electrical wires 3) that are drawn out from the second terminals 51 are fitted into the second guide grooves 48. For this reason, it is possible to reliably prevent the tangling of the electrical wires 3, such as the tangling of the portions of the first electrical wires 3*a* drawn out from the first terminals 50 and the portions of the second electrical wires 3*b* drawn out from the second terminals 51.

According to the connector 1 of the present embodiment, the first support portion 24 is provided with the first inclined surface 45, and the second support portion 25 is provided with the second inclined surface 46. The first inclined surface 45 is formed by providing the first support portion 24 such that the thickness thereof decreases toward one side of the housing 21 in the front-rear direction X. Also, the second inclined surface 46 is formed by providing the second support portion 25 such that the thickness thereof decreases toward the other side of the housing 21 in the front-rear direction X. For this reason, the first electrical wires 3*a* are guided by the first inclined surface 45 so as to be easily fitted into the first guide grooves 47 along the extending direction. Also, the second electrical wires 3*b* are guided by the second inclined surface 46 so as to be easily fitted into the second guide grooves 48 along the extending direction. Accordingly, the first electrical wires 3*a* can be easily fitted into the first guide grooves 47 and the second electrical wires 3*b* can be easily fitted into the second guide grooves 48.

The connector 1 of the present embodiment includes the housing 21 and the terminals 20 held in the housing 21, and the housing 21 is provided with the electrical wire holding portions 28 configured to hold portions of the electrical wires 3. The electrical wire holding portions 28 are configured to hold portions other than the end portions of the electrical wires 3 that extend from corresponding terminals 20, the held portions being portions that extend from bent portions of the electrical wires 3. Alternatively the electrical wire holding portions 28 are configured to hold portions other than the end portions of electrical wires 3 that extend from the other connector 1*a* different from the connector 1.

Therefore, according to the connector 1, in the case where the electrical wire holding portions 28 are to hold portions, other than the end portions, that extend from the bent portions of the electrical wires 3 that extend from the terminals 20, such portions of the electrical wires 3 can be held in the electrical wire holding portions 28. Accordingly it is possible to suppress the case where the electrical wires 3 that extend from the connector 1 become a hinderance when the connector 1 is transported, and the tasks of connection to and arrangement on the connection target member can be performed easily.

Also, according to the connector 1, in the case where the electrical wire holding portions 28 are to hold portions, other than the end portions, of electrical wires 3 that extend from the other connector 1*a* that is different from the connector 1, a worker transporting the connector 1 can use the electrical wire holding portions 28 of the connector 1 to hold the electrical wires 3 that extend from the other connector 1*a*, and it is possible to suppress the case where the electrical wires 3 become a hinderance when connecting and arranging the connector 1. Accordingly the worker can suppress the case where the electrical wires 3 become a hinderance, and can easily perform the tasks of connection to and arrangement on the connection target member.

Therefore, according to the present embodiment, it is possible to suppress the case where the electrical wires 3 become a hinderance during the tasks of connecting and arranging the connector 1, and the tasks of connection to and arrangement on the connection target member can be performed easily.

According to the connector 1 of the present embodiment, the electrical wire holding portions 28 are configured as the holding grooves 30 that are shaped as grooves. For this reason, the electrical wires 3 drawn out from the terminals 20 are fitted into and held in the holding grooves 30. Accordingly the electrical wires 3 are fitted into and reliably held in the electrical wire holding portions 28, and it is possible to prevent the electrical wires 3 from coining out of the electrical wire holding portions 28 even when the connector 1 is being transported. As a result, it is possible to more reliably prevent the electrical wires 3 from hindering operations when the connector 1 is arranged.

According to the connector 1 of the present embodiment, the drawn direction of the electrical wires 3 connected to the terminals 20 and the extending direction of the holding grooves 30 are parallel with each other. For this reason, the portions of the electrical wires 3 drawn out from the terminals 20 can be held in a straight shape by the holding grooves 30, Accordingly, the connector 1 can compactly and efficiently hold the portions of the electrical wires 3 drawn out from the housing 21.

According to the connector 1 of the present embodiment, the projections 31 are provided on the inner surfaces of the holding grooves 30, and the projections 31 prevent the electrical wires 3 held in the holding grooves 30 from moving out of the holding grooves 30. For this reason, the electrical wires 3 held in the holding grooves 30 are caught on the projections 31 and are not likely to fall out of the holding grooves 30. Accordingly the worker can reliably prevent the electrical wires 3 from coming out of the holding grooves 30 and hindering operations when transporting the connector 1.

The connector 1 of the present embodiment includes the housing 21 and the terminals 20 held in the housing 21, and the housing 21 includes the housing main body portion 22 and the pairs of projection portions 23 that project from the housing main body portion 22. Also, the projection portions 23 in each pair project from the housing main body portion 22 to respective sides in the direction perpendicular to the direction in which the electrical wires 3 are drawn out from the terminals 20 held by the housing main body portion 22. The projection portions 23 each have a hold target portion 32 that is a portion held by the holding tools 34 for holding the connector 1. For this reason, the hold target portions 32 of individual connectors 1 can be held and transported by the holding tools 34.

Also, according to the connector 1, the projection portions 23 each include the positioning portion 33 that has multiple slide surfaces 41 and is a portion configured for use when the connector 1 is positioned. For this reason, by attaching the rail members 39 having a shape that corresponds to the slide surfaces 41 in order to be able to stack multiple connectors 1 for example, it is possible to stack multiple connectors 1 into a group. As a result, the worker can easily perform a task of gripping and transporting multiple connectors 1. Also, because the connectors 1 include the above-described pairs of projection portions 23, the worker can also easily perform a task of successively gripping and transporting individual connectors 1 from the stacked group.

Therefore, according to the present embodiment, it is possible to easily perform a task of gripping and transporting individual connectors 1 in order to form a compact group of connectors 1, and it is also possible to easily perform a task of successively gipping and transporting individual connectors 1 from a compactly stacked group of connectors 1.

According to the connector 1 of the present embodiment, the positioning portions 33 are shaped as grooves. For this reason, when multiple connectors 1 are stacked, the groove-shaped positioning portions 33 of the connectors 1 reliably fit to the rail members 39 whose shape corresponds to the slide surfaces 41. Accordingly, the connectors 1 can slide along the rail members 39 in a stable state.

Also, according to the connector 1, the hold target portions 32 have the recession portions 35 that are shaped as recessions into which the holding tools 34 fit. For this reason, the connector 1 is held in a state where the holding tools 34 fit into the recession portions 35. The hold target portions 32 each also have the step portion 36 that is arranged side-by-side with the recession portion 35 in the height direction of the housing 21 and has a level difference relative to the recession portion 35. For this reason, the connector 1 is held by the holding tools 34 whose shape corresponds to the level difference formed by the step portions 36, and the connector 1 is thus stably held so as to not shift in the height direction H.

Furthermore, according to the connector 1, a pair of projection portions 23 is provided on both the end portion on one side and the end portion on the other side of the housing 21 in the direction parallel with the drawn direction of the electrical wires 3. Also, the lock portions 26 configured to engage with and lock the partner connector 2 are provided between the pair of projection portions 23 on the one end portion and the pair of projection portions 23 on the other end portion. In other words, the pairs of projection portions 23 are respectively provided on the one end portion and the other end portion of the housing 21, and the lock portions 26 are provided between the pairs of projection portions 23 so as to engage with the partner connector 2. For this reason, in the connector 1, the lock portions 26 engage with the partner connector 2 at or near the center of gravity between the two end portions of the housing 21, thus making it possible to more reliably maintain a more stable and firm connected state.

Variations

Although an embodiment of the present invention has been described thus far, the present invention is not limited to the above-described embodiment, and various modifications can be made within the scope recited in the claims. In other words, the present invention is not limited to the above embodiment, and all modifications, applications, and equivalents thereof that fall within the claims, for which modifications and applications would become naturally apparent by reading and understanding the present specification, are intended to be embraced in the claims of the invention. For example, variations such as the following may be carried out.

(1) Although the above embodiment describes an example of the case where a pair of projection portions 23 is provided on both the front side and the rear side in the front-rear direction X of the connector 1, there is no limitation to this. For example, each connector 1 may be provided with only one pair of projection portions 23.

(2) Also, although the above embodiment describes an example of the case where a pair of projection portions 23 is provided on both the front side and the rear side of the housing 21 in the front-rear direction X, there is no limitation to this. For example, the pairs of projection portions 23 may be provided in the central portion of the housing 21 in the front-rear direction X.

(3) Also, although the above embodiment describes an example of the case where the recession portions 35 are configured to include two inclined surfaces so as to be open outward in the width direction W of the housing 21, the recession portions 35 may be configured to include three or more inclined surfaces or a curved surface so as to be open outward in the width direction W of the housing 21, for example.

INDUSTRIAL APPLICABILITY

The present invention is widely applicable to various applications as a connector for connecting multiple electrical wires to a connection target member.

What is claimed is:

1. A connector comprising:

a plurality of first terminals;

a plurality of second terminals; and a housing configured to hold the first terminals and first electrical wires respectively connected to the first terminals, and the second terminals and second electrical wires respectively connected to the second terminals, wherein the first terminals are arranged along a width direction of the housing, and the second terminals are arranged along the width direction of the housing, in the housing, the first terminals are arranged with the second terminals along a front-rear direction of the housing that is perpendicular to the width direction of the housing, and in a state where the first electrical wires connected to the first terminals are drawn out from the first terminals to one side in the front-rear direction of the housing, and the second electrical wires connected to the second terminals are drawn out from the second terminals to another side in the front-rear direction of the housing, wherein the housing includes a first support portion that is plate-shaped and configured to support portions of the first electrical wires connected to the first terminals, the supported portions being portions that are drawn out from the first terminals, and a second support portion that is plate-shaped and configured to support portions of the second electrical wires connected to the second terminals, the supported portions being portions that are drawn out from the second terminals, wherein the first support portion is provided with first guide grooves into which portions of the first electrical wires are fitted, the fitted portions being portions that are connected to and drawn out from the first terminals, and the second support portion is provided with second guide grooves into which portions of the second electrical wires are fitted, the fitted portions being portions that are connected to and drawn out from the second terminals, wherein the first support portion is provided with a first inclined surface formed by providing the first support portion such that a thickness of the first support portion decreases toward the one side in the front-rear direction, and the second support portion is provided with a second inclined surface formed by providing the second support portion such that a thickness of the second support portion decreases toward the other side in the front-rear direction.

2. A connector comprising:

a housing; and a plurality of terminals held in the housing, wherein the housing includes a housing main body portion configured to hold the plurality of terminals to which electrical wires are to be respectively connected, and a pair of projection portions that project from the housing main body portion, the pair of projection portions respectively extending at front and rear ends in a front-rear direction of the housing resulting in four projection portions;

each pair of projection portions project from the housing main body portion to respective sides in a direction perpendicular to a direction in which the electrical wires are drawn out from the terminals held in the housing main body portion, and each of the four projection portions each includes a positioning portion that has a plurality of slide surfaces and is a portion configured for use when the connector is positioned, and a hold target portion that is a portion configured to be held by a holding tool for holding the connector.

3. The connector according to claim 2, wherein the positioning portion is shaped as a groove, the hold target portion includes a recession portion that is shaped as a recession into which the holding tool fits, and a step portion that is arranged side-by-side with the recession portion in a height direction of the housing and has a level difference relative to the recession portion, the pair of projection portions is provided on both one end portion and another end portion of the housing with respect to a direction parallel with a drawn direction of the electrical wires, and a lock portion configured to engage with and lock a partner connector is provided between the pair of projection portions on the one end portion and the pair of projection portions on the other end portion.

4. A connector comprising:

a housing; and a plurality of terminals held in the housing, wherein at least two of the plurality of terminals are arranged opposite one another such that when the at least two terminals are connected to an end of respective electrical wires, said electrical wires are drawn out and extend in opposite directions;

at least one of the respective electrical wires extends beyond the housing to a second connector, the second connector comprising; an electrical wire holding portion through which said electrical wire extends without connection to any terminals within the second connector.

5. The connector according to claim 4, wherein the electrical wire holding portion is a holding groove that is shaped as a groove into which the at least one respective electrical wire is fitted.

6. The connector according to claim 5, wherein the holding groove is provided extending parallel with a direction in which the at least one respective electrical wire connected to the terminal is drawn out.

7. The connector according to claim 5, wherein a projection is formed on an inner surface of the holding groove, the projection being configured to prevent the at least one respective electrical wire fitted into the holding groove from moving out of the holding groove.

* * * * *